US005091640A

United States Patent [19]

Cornhill et al.

[11] Patent Number: 5,091,640

[45] Date of Patent: Feb. 25, 1992

[54] PHASE ADVANCE FOR AMBIENT LIGHT SUPPRESSION IN PHOTOTRANSISTORS

[75] Inventors: Colin V. Cornhill, Corsham, England; Charles K. Carlin, Raleigh, N.C.

[73] Assignee: Square D Company, Palatine, Ill.

[21] Appl. No.: 719,896

[22] Filed: Jun. 24, 1991

[51] Int. Cl.[5] ..... H01J 40/14

[52] U.S. Cl. ..... 250/214 R; 330/308

[58] Field of Search ..... 250/214 R, 214 A, 214 B, 250/214 C; 307/273, 289; 330/59, 82, 107, 149, 308, 294; 331/105

[56] References Cited

U.S. PATENT DOCUMENTS 4,247,765 1/1981 Bergström ..... 250/214 R 5,008,524 4/1991 Reutter et al. ..... 250/214 A

*Primary Examiner*—David C. Nelms

*Assistant Examiner*—John R. Lee

*Attorney, Agent, or Firm*—Michael J. Femal

[57] ABSTRACT

The invention provides an oscillatory suppression circuit (54) for use in a photosensor loop circuit (10) employing a phototransistor (14). The oscillation suppression circuit (54) prevents oscillation in the photosensor loop circuit (10) caused by detected unmodulated high frequency light. The oscillatory suppression circuit (54) includes a resistor (58) and a capacitor (62) connected in series, and also connected in parallel with a base resistor (38) of a feedback transistor (26). The oscillatory suppression circuit (54) adds a small amount of phase advance to a feedback circuit (50). This small phase advance counteracts any additional negative phase shift produced when intense light pluses are detected by the phototransistor (14) and amplified by the high gain of the feedback circuit (50).

1 Claim, 1 Drawing Sheet

PHASE ADVANCE FOR AMBIENT LIGHT SUPPRESSION IN PHOTOTRANSISTORS

FIELD OF THE INVENTION

The present invention relates to the technology of photosensors. Specifically, the invention relates to a circuit for eliminating oscillation in a photosensor loop circuit of photosensors using phototransistors to detect a modulated light source.

BACKGROUND OF THE INVENTION

A basic photosensor loop detection circuit for a phototransistor sensor device is shown and described in the 1990 Siemens Optoelectronics Data Book in General Photoelectric Application Circuits Application Note 36, page 11-104. The circuit disclosed therein has a low frequency signal filter for rejecting ambient light signals in the 120 $H_z$ range. High frequency light pulses emitted by, and used within the photosensor system are not filtered out. Certain unmodulated high frequency light signals detected by the sensor may also be passed into a feedback circuit and amplified by the high gain of a feedback transistor and a phototransistor. The amplified signal may cause oscillation in the photosensor loop circuit. Oscillation in the circuit reduces the sensitivity of the phototransistor thereby reducing the effectiveness of the photosensor. Oscillation may occur when the loop feedback becomes positive (less than −90° or greater than −270°). The Siemens ambient light filtering circuit induces a negative feedback into the phototransistor base circuit. This is accomplished by the feedback transistor which causes a 180° negative phase shift and a feedback transistor base resistor and a feedback transistor bypass capacitor which combine to provide an additional 90° of negative phase shift for a total of 270° of negative feedback on the phototransistor base. However, because the phototransistor has parasitic base capacitance, certain detected intense light will cause an additional few degrees of negative phase shift to occur. This additional negative phase shift added to the −270° already produced by the circuit results in some minimal positive feedback (greater than −270°).

SUMMARY OF THE INVENTION

An ambient light oscillatory suppression circuit of the present invention minimizes any oscillation in the photosensor loop circuit caused by detected unmodulated high frequency light. The oscillatory suppression circuit comprises a resistor and a capacitor in series with one another and connected in parallel with the base resistor of Siemen's feedback transistor disclosed in the 1990 Siemens Optoelectronics Data Book, General Photoelectric Application Circuits Application Note 36, page 11-104. The oscillatory suppression circuit induces a small phase advance into the feedback circuit. The induced phase advance is large enough to counteract any additional negative phase shift from the phototransistor base when certain intense light signals are detected.

Other features and advantages of the invention will become apparent to those skilled in the art upon review of the following detailed description, claims and drawings.

Figure 1:
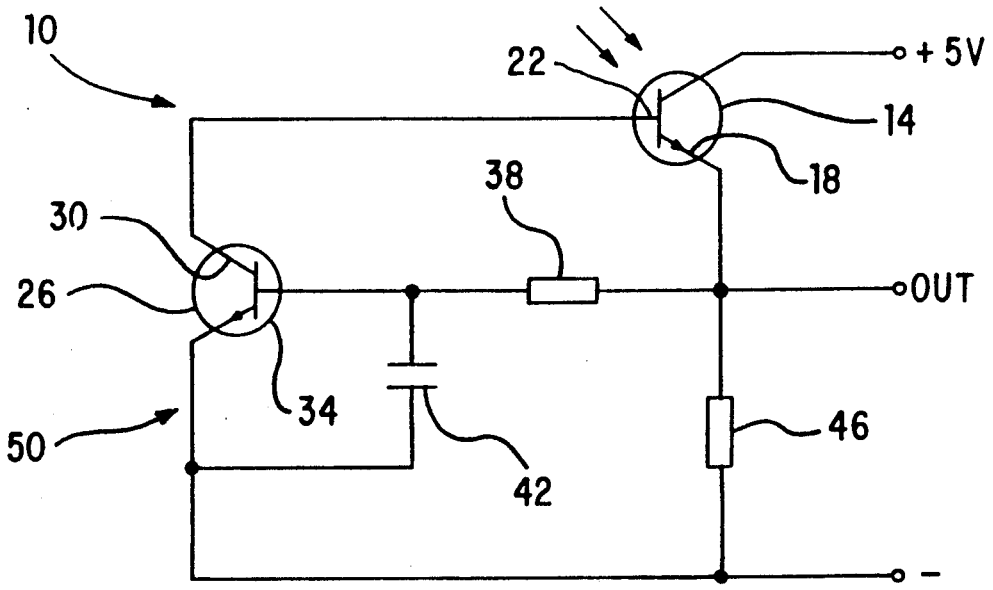
FIG. 1 PRIOR ART
FIG. 1 is a schematic of the photosensor loop circuit disclosed in the 1990 Siemens Optoelectronics Data Book in General Photoelectric Application Circuits Appnote 36, page 11-104.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Figure 2:
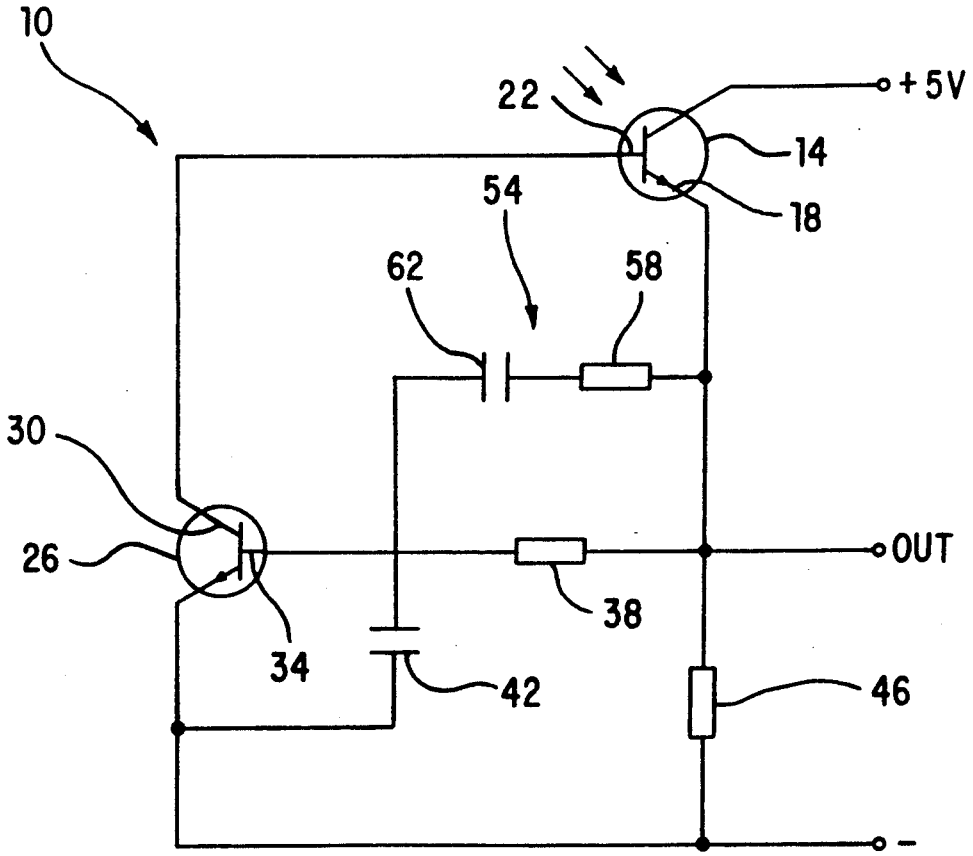
FIG. 2 is a schematic of the photosensor loop circuit of FIG. 1 including the oscillatory suppression circuit.

The photosensor loop circuit 10 as disclosed in the 1990 Siemens Optoelectronics Data Book in General Photoelectric Application Circuits Application Note 36, page 11-104, and shown in FIG. 1 includes a silicon NPN epitaxial phototransistor 14 having an emitter 18 for output and a base 22 for control, a feedback transistor 26 having a collector 30 for output and a base 34 for control, a 4.7 MΩ base resistor 38, a 0.1 uf bypass capacitor 42, and a 10 KΩ output resistor 46 across which the output of the photosensor loop circuit 10 is taken. The Siemens feedback circuit 50 is comprised of the feedback transistor 26, the base resistor 38, and the bypass capacitor 42. The circuit of FIG. 2 includes the photosensor loop circuit 10 of FIG. 1 and an oscillatory suppression circuit 54 of the present invention. The oscillatory suppression circuit 54 includes a 330 KΩ resistor 58 connected in series with a 47 pf capacitor 62. The oscillatory suppression circuit 54 is connected in parallel with the base resistor 38 between the emitter 18 of the phototransistor 14 and the base 34 of the feedback transistor 26.

The photosensor loop circuit 10 is intended to detect and process modulated light. When a low frequency light source is detected by the phototransistor 14, the base resistor 38 and bypass capacitor 42 act as a filter to remove it from the photosensor loop circuit 10. This filtering action prevents detected low frequency light from developing a signal across the output resistor 46. Due to the time constant produced by base resistor 38 and bypass capacitor 42, certain intense light pulses detected by the phototransistor 14 may not be filtered out of the photosensor loop circuit 10. These unfiltered intense light pulses may be passed into the feedback circuit 50 of the Seimens device where they are amplified by the high gain of the phototransistor 14 and the feedback transistor 26. The amplified light pulses may produce oscillation in the photosensor loop circuit 10 rendering the circuit ineffective or reduce the sensitivity of the phototransistor 14. The frequency above which the photosensor loop circuit 10 becomes ineffective is determined by this time constant, which is determined by the values of base resistor 38 and bypass capacitor 42. The values of base resistor 38 and bypass capacitor 42 are usually chosen to suppress light in the 120 $H_z$ range, light emitted by lamps for illuminization.

To prevent oscillation in the feedback circuit 50, the feedback on the phototransistor 14 must be negative. If the feedback becomes positive (less than −90° or more than −270°) oscillation may occur in the photosensor loop circuit 10. The feedback is made negative by inducing a negative phase shift into the feedback circuit 50. The feedback transistor 18 induces a 180° negative phase shift and the base resistor 38 and bypass capacitor 42 combine to induce an additional 90° of negative phase shift for a total of 270° of negative feedback to the base of the phototransistor 14. Any additional negative phase shift could result in some minimal positive feedback (greater than −270°) and therefore could cause oscillation in the photosensor loop circuit 10. The resistor 58 and capacitor 62 of the oscillatory suppression circuit 54 combine to induce a small phase advance into the photosensor loop circuit 10. This small phase advance counteracts the negative phase shift caused by the phototransistor 14 base, thus preventing oscillation in the photosensor loop circuit 10.

We claim:

1. An oscillatory suppression circuit for preventing loop oscillation in a feedback circuit of a photosensor loop circuit including a phototransistor having an emitter, a collector connected to a supply voltage, and a base, a feedback transistor having a base connected through a feedback base resistor to the emitter of the phototransistor, and a feedback transistor bypass capacitor connected between the base and emitter of the feedback transistor; said oscillatory suppression circuit comprising:

(a) a resistor having a first and a second end, said first end connected to the emitter of the phototransistor;

(b) a capacitor, having a first and second end, said first end connected to said second end of said resistor and said second end connected to the base of the feedback transistor in the photosensor loop circuit, said resistor and said capacitor are connected in parallel across the base resistor of the feedback transistor for inducing a phase advance into the feedback circuit to prevent oscillation in the photosensor loop circuit.

* * * * *